US007470008B2

(12) United States Patent
Yan

(10) Patent No.: US 7,470,008 B2
(45) Date of Patent: Dec. 30, 2008

(54) SIMPLIFIED REFILLING ASSEMBLY OF DURABRITE INK CARTRIDGE

(75) Inventor: Yi-Tsung Yan, Taipei (TW)

(73) Assignee: Ti-Tsung Yan, Taipei (TW)

( * ) Notice: Subject to any disclaimer, the term of this patent is extended or adjusted under 35 U.S.C. 154(b) by 466 days.

(21) Appl. No.: 11/373,187

(22) Filed: Mar. 13, 2006

(65) Prior Publication Data

US 2007/0024683 A1 Feb. 1, 2007

(30) Foreign Application Priority Data

Jul. 29, 2005 (TW) ..... 94212936 U

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/85, 86; 141/18
See application file for complete search history.

(56) References Cited

U.S. PATENT DOCUMENTS 5,709,253 A * 1/1998 Maerzke ..... 141/18
7,364,281 B2 * 4/2008 Yan ..... 347/85
7,367,660 B2 * 5/2008 Koga et al. ..... 347/85
2007/0139489 A1 * 6/2007 Wang ..... 347/84
2007/0200905 A1 * 8/2007 Nakashima ..... 347/85

* cited by examiner

*Primary Examiner*—Stephen D Meier
*Assistant Examiner*—Carlos A Martinez, Jr.
(74) *Attorney, Agent, or Firm*—Troxell Law Office, PLLC

(57) ABSTRACT

A simplified refilling assembly of DURABrite ink cartridge comprises an ink bottle connector, a pipe and an ink cartridge connector; the ink cartridge connector has a plug pipe to be connected with the refilling hole of the ink cartridge hermetically; the ink bottle connector is furnished with a L-shaped connector and a recovering cylinder, which are molded into one piece to be plugged into a bottle plug of the ink bottle; the ink cartridge and the ink bottle are connected each other by means of a refilling assembly; a syringe is plugged into the refilling hole of the ink cartridge; when the pull grip is pulled upward, the ink in the ink bottle will be drawn to flow into the ink chamber of the ink cartridge; then, the syringe is plugged into the recovering cylinder of the ink bottle connector so as to recover ink for re-use.

13 Claims, 14 Drawing Sheets

SIMPLIFIED REFILLING ASSEMBLY OF DURABRITE INK CARTRIDGE

BACKGROUND OF THE INVENTION

1. Field of the Invention

This invention relates to an ink cartridge, and particularly to a simplified refilling assembly of DURABrite ink cartridge.

2. Description of the Prior Art

The conventional refilling assembly of an ink cartridge usually comprises a bottle mounted with a refilling needle; the ink bottle can be squeezed for refilling ink.

Another conventional refilling assembly usually comprises a refilling cylinder, which is filled up with ink; one end of the refilling cylinder is plugged into the refilling hole of an ink cartridge; then, the refilling cylinder is pulled to provide a vacuum effect so as to refill ink.

In Epson's products, it includes separate ink cartridges, called DURABrite ink cartridge; in order to save a consummer from two times of refilling an ink cartridge, the ink cartridge is partitioned into two ink chambers, which are connected, in communication, with a capillary tube; according to such a conventional method, ink can only be refilled into an ink chamber underneath; the refilling operation is done by means of a vacuum effect; in that case, the loop circuit of the ink chamber are filled which air bubbles; then, the loop circuit of the ink cartridge will have a bubble blockage to cause the ink unable to flow through the ink outlet smoothly, and then the printer would fail to print.

SUMMARY OF THE INVENTION

The prime object of the present invention is to provide a refilling assembly connected between a DURABrite ink cartridge and an ink bottle; a syringe is plugged into the ink outlet of an ink cartridge; when the syringe is pulled, the ink refilling operation for a DURABite ink cartridge can be done quickly.

Another object of the present invention is to provide a refilling assembly, in which an ink cartridge connector is plugged into the refilling hole of the ink cartridge; one end of the ink cartridge connector has a plug pipe to be plugged hermetically into the refilling hole of the ink cartridge, while the outer end thereof has a grip plate to be gripped with hand so as to facilitate it to be connected or separated from the refilling hole of the ink cartridge easily and quickly.

Still another object of the present invention is to provide a refilling assembly, in which an ink bottle connector includes a L-shaped connecto and a recovering cylinder molded together as one piece, and it is to be plugged to a bottle plug of the ink bottle; one end of the L-shaped connector is plugged into the ink bottle, while other end thereof is connected with a tube for guiding the ink to flow; one end of the recovering cylinder is plugged into the ink bottle, while other end thereof is mounted with a seal ring; after the ink cartridge is filled up, the ink in the syringe can easily be recovered into the ink bottle for re-use next time.

A further object of the present invention is to provide a refilling assembly, in which one end of the ink bottle connector has at least a plug pipe to fit to different type of ink cartridge upon refilling; the plug pipe is designed to match with the size of the cylindrical hole of an ink cartridge manufactured in the original factory for the first time refilling operation; the grip plate on the other end thereof is designed to facilitate gripping and applying force so as to have the plug pipe of the ink cartridge connector plugged into the refilling hole of the ink cartridge closely and hermetically.

A still further object of the present invention is to provide a refilling assembly, in which the center of the plug pipe of the ink cartridge connector has a cylindrical hole, which extends in a L-shaped direction along the grip plate, and which has a connector to be connected with a tube; the ink cartridge connector is plugged into the refilling hole of the ink cartridge so as to guide ink to flow into the ink chamber of the ink cartridge.

Yet another object of the present invention is to provide a refilling assembly, in which the top of the recovering cylinder of the ink bottle connector has a seal ring, of which the outer edge has a ring-shaped flange to be fastened in place with an outer lid; the center of the outer lid has a cylindrical hole; the upper edge of the seal ring has a recess hole and a through hole under the recess hole; the through hole is designed to match with the size of a plug pipe of the ink cartridge connector; after the ink cartridge is filled up with ink, the ink bottle connector at one end of the refilling assembly is still plugged into the ink bottle, while the ink cartridge connector on other end of the refilling assembly is to be plugged into the recovering cylinder on the ink bottle connector.

Yet still another object of the present invention is to provide a refilling assembly, in which the top of the recovering cylinder of the ink bottle connector is furnished with a seal ring to be fasted in place with an outer lid; the seal ring is made of silicon having a better tough flexibility; the center of the seal ring has a through hole, of which the diameter is slightly smaller than that of the plug pipe on the front of the syringe; after the ink cartridge is filled up, the syringe is plugged into the recovering cylinder so as to have the ink in the syringe recovered.

DETAILED DESCRIPTION OF THE PREFERRED EMBODIMENT

Figure 1:
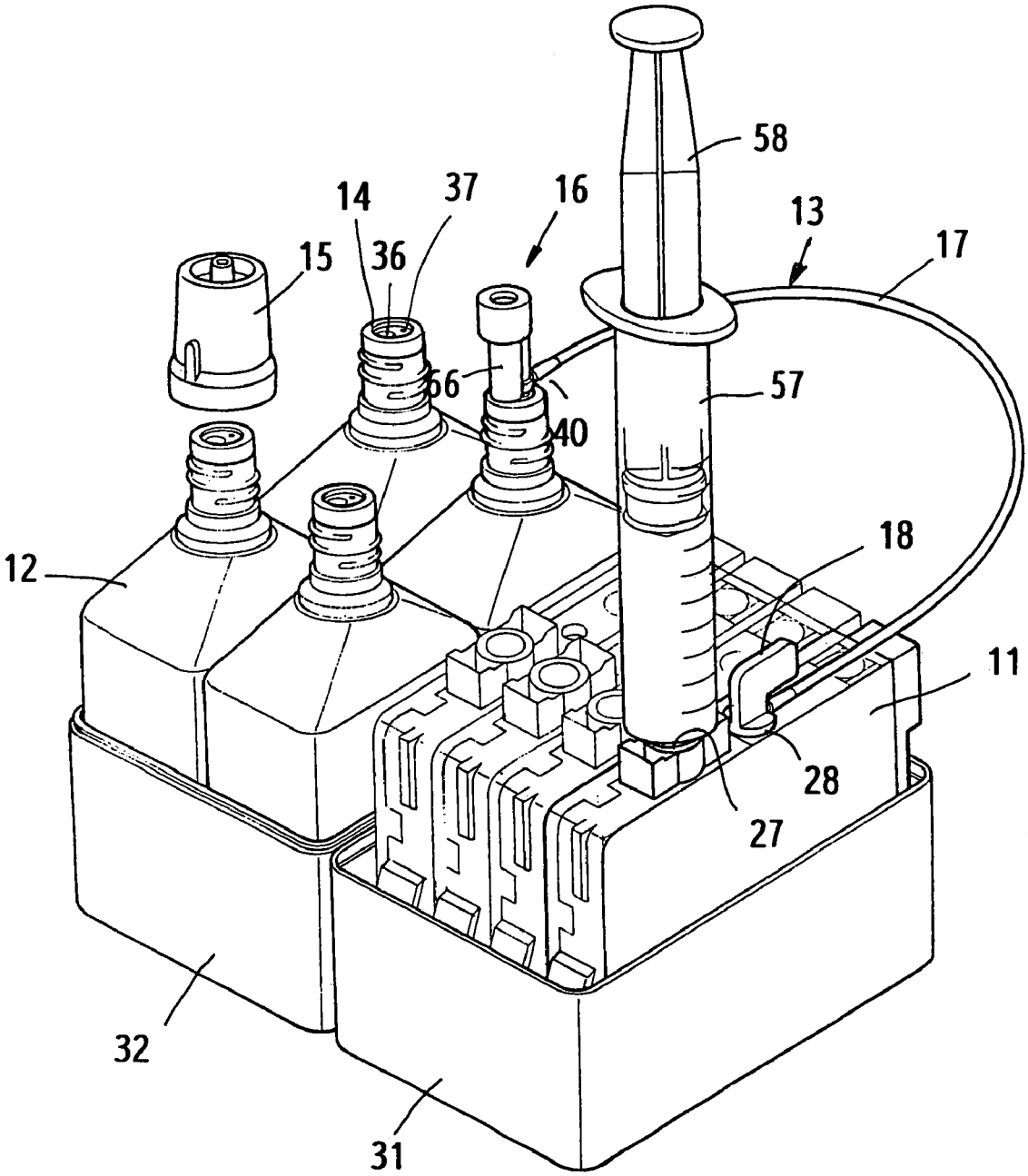
FIG. 1 is a perspective view of the present invention, showing the refilling assembly connected between an ink bottle and an ink cartridge upon ink-refilling operation.
Figure 10:
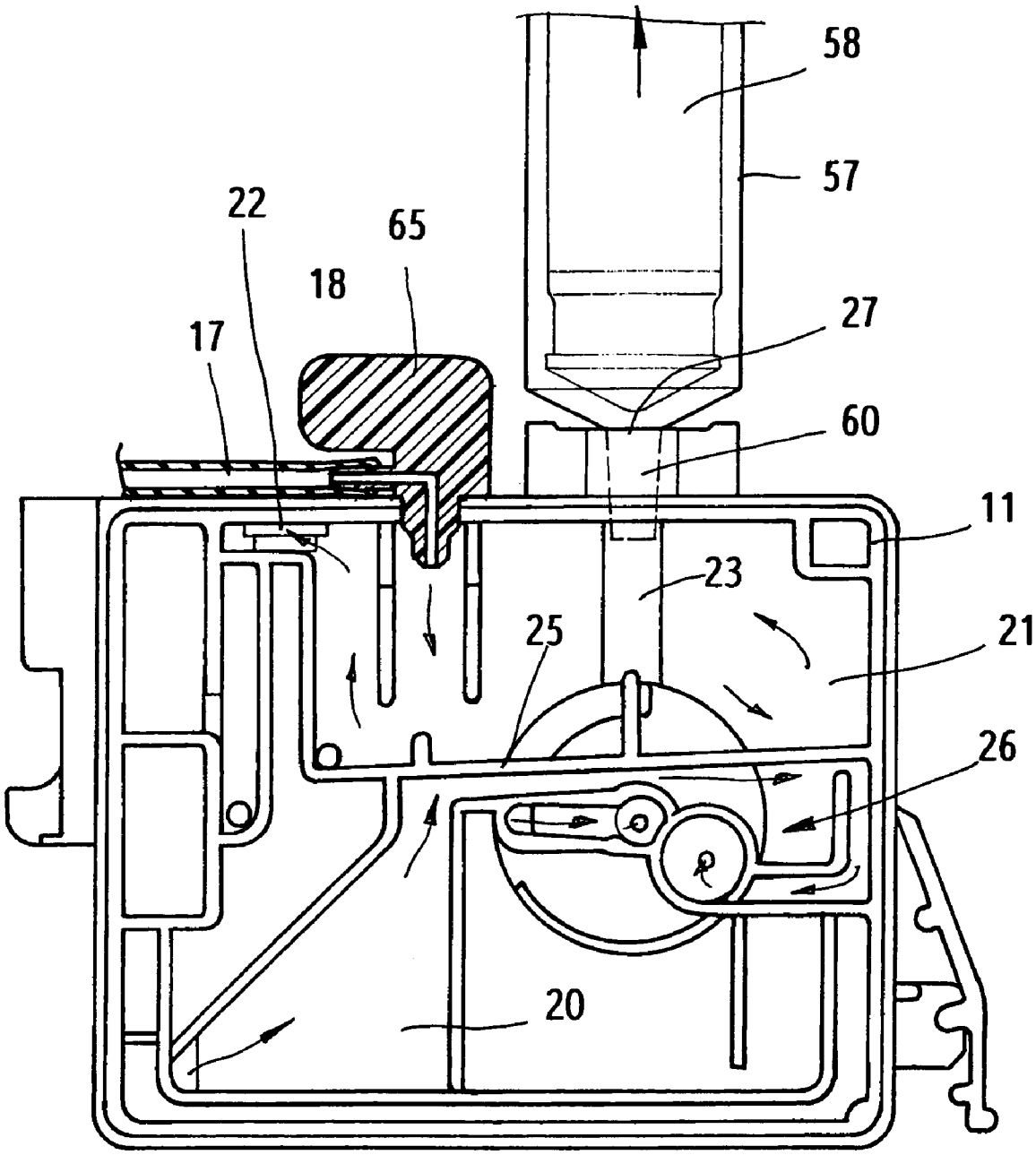
FIG. 10 is a sectional view of the present invention, showing the ink cartridge being in refilling operation.

This invention relates to a simplified refilling assembly of DURABrite cartridge; as shown in FIGS. 1 and 10, the ink cartridges 11 are put in a containing box 31 first, while the ink bottles are put in another containing box 32, the ink bottle connector 16 of a refilling assembly 13 is connected with the top of the ink bottle 12, while the ink cartridge connector 18 is connected with the refilling hole 28 of the ink cartridge 11; the ink outlet 27 of the ink cartridge 11 is plugged with a syringe 57, of which the pull grip 58 can be pulled upwards to provide a vacuum effect so as to have the ink in the ink bottle 12 flowed, via the refilling assembly 13, into the second ink chamber 21 of the ink cartridge 11; then, the ink flows into the first ink chamber 20 via the capillary tube 22; then, the ink flows through the loop circuit 26, the ink storage chamber 23, and the ink outlet 27, into the syringe 57. After the ink cartridge 11 is filled up, the ink left in the syringe 57 will be recovered, via the refilling assembly 13 and the recovering cylinder 66 of the ink bottle connector 16, into the ink bottle 12; finally, remove the ink cartridge connector 18 of the refilling assembly 13, and plug the connector 18 into the ink bottle connector 16; the refilling hole 28 of the ink cartridge 11 is sealed with a plastic plug; then, the ink cartridge 11 can be mounted on the printer for printing operation.

Figure 2:
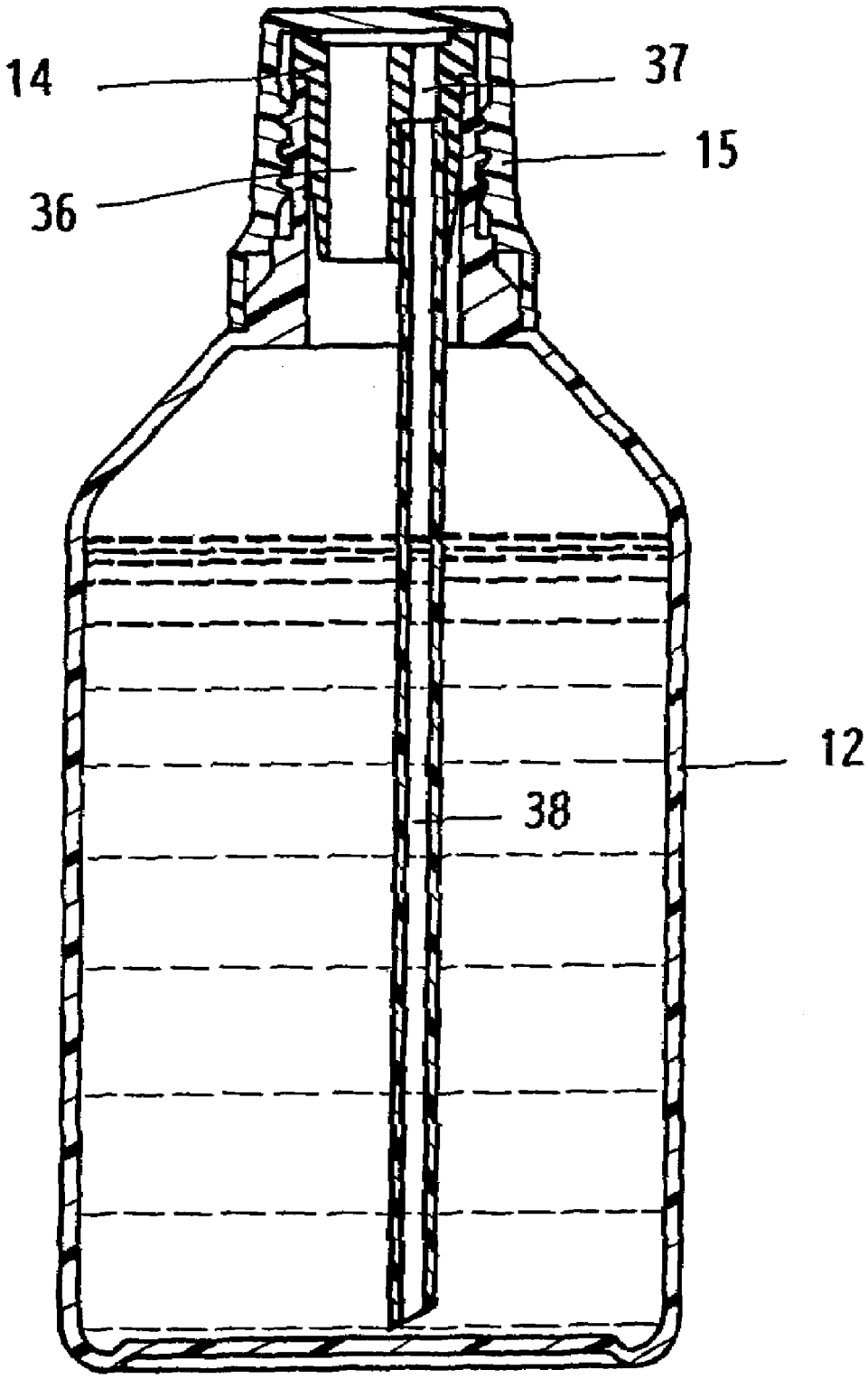
FIG. 2 is a sectional view of he present invention, showing an ink bottle sealed hermetically.
Figure 3:
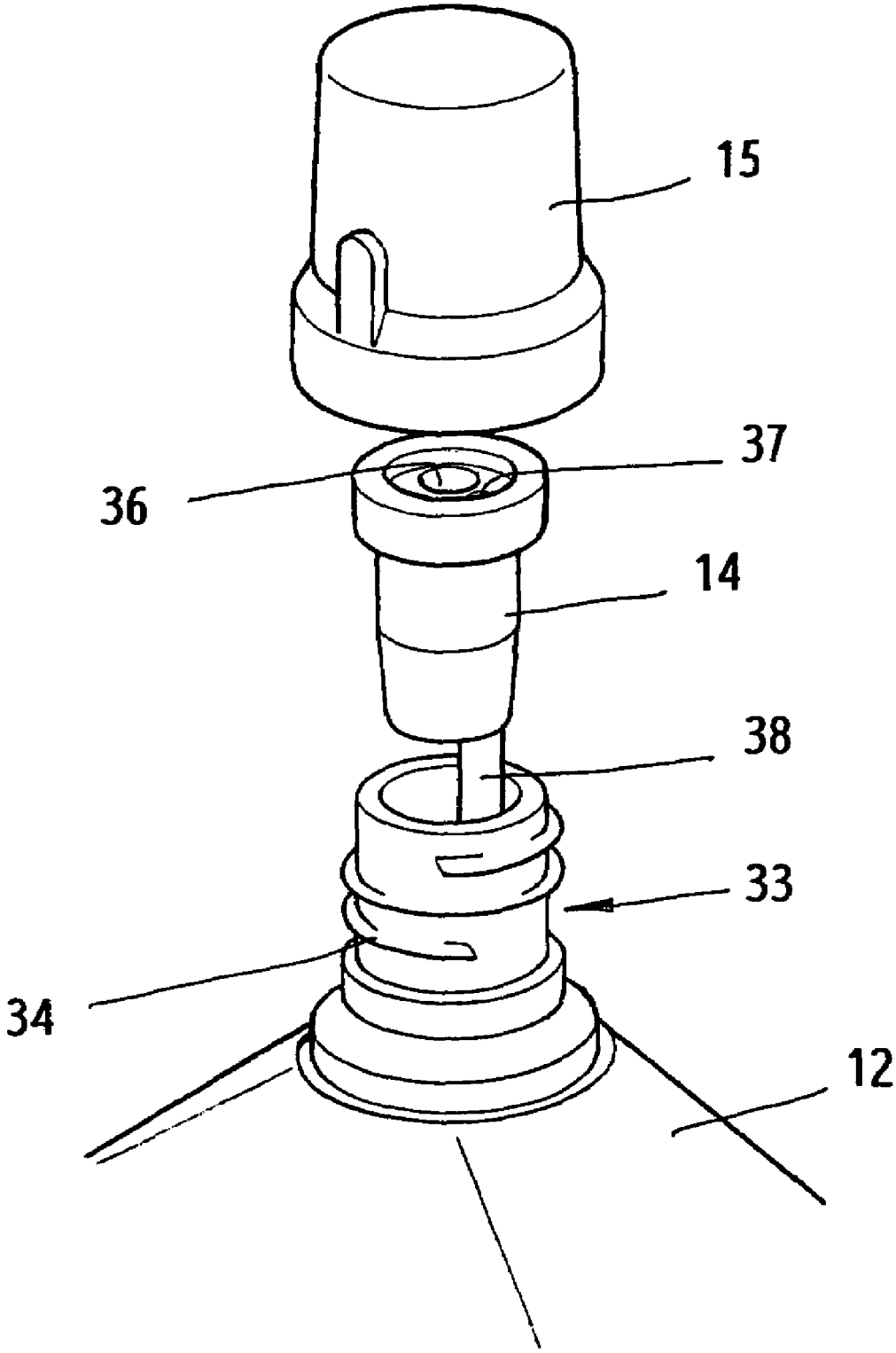
FIG. 3 is a disassembled view of the present invention, showing the assembly mounted on the ink bottle.
Figure 4:
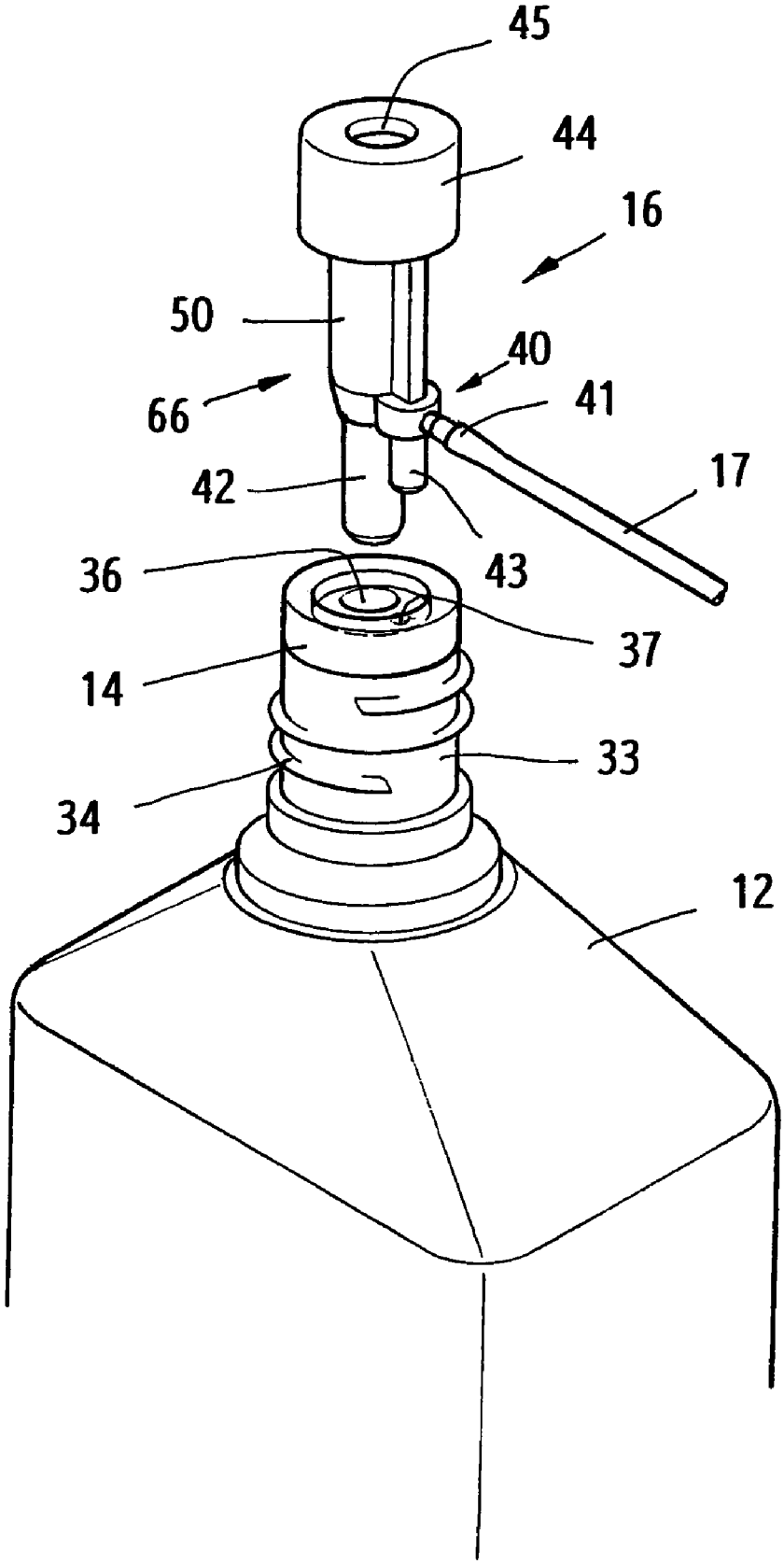
FIG. 4 is a disassembled view of the present invention, showing the assembled relation between the ink bottle and the connection assembly.
Figure 5:
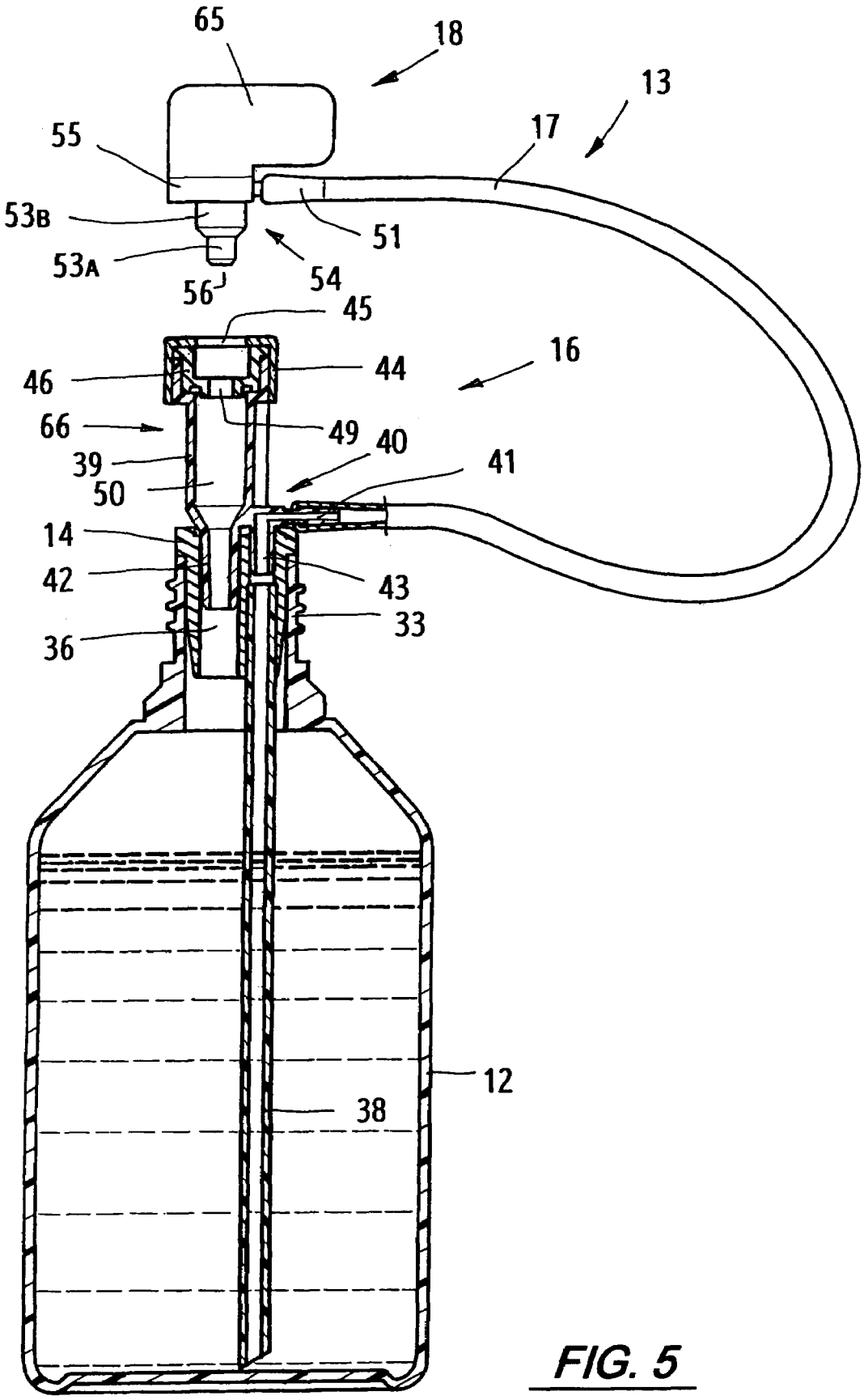
FIG. 5 is a sectional view of the present invention, showing the assembled relation between the ink bottle and the connection assembly.
Figure 6:
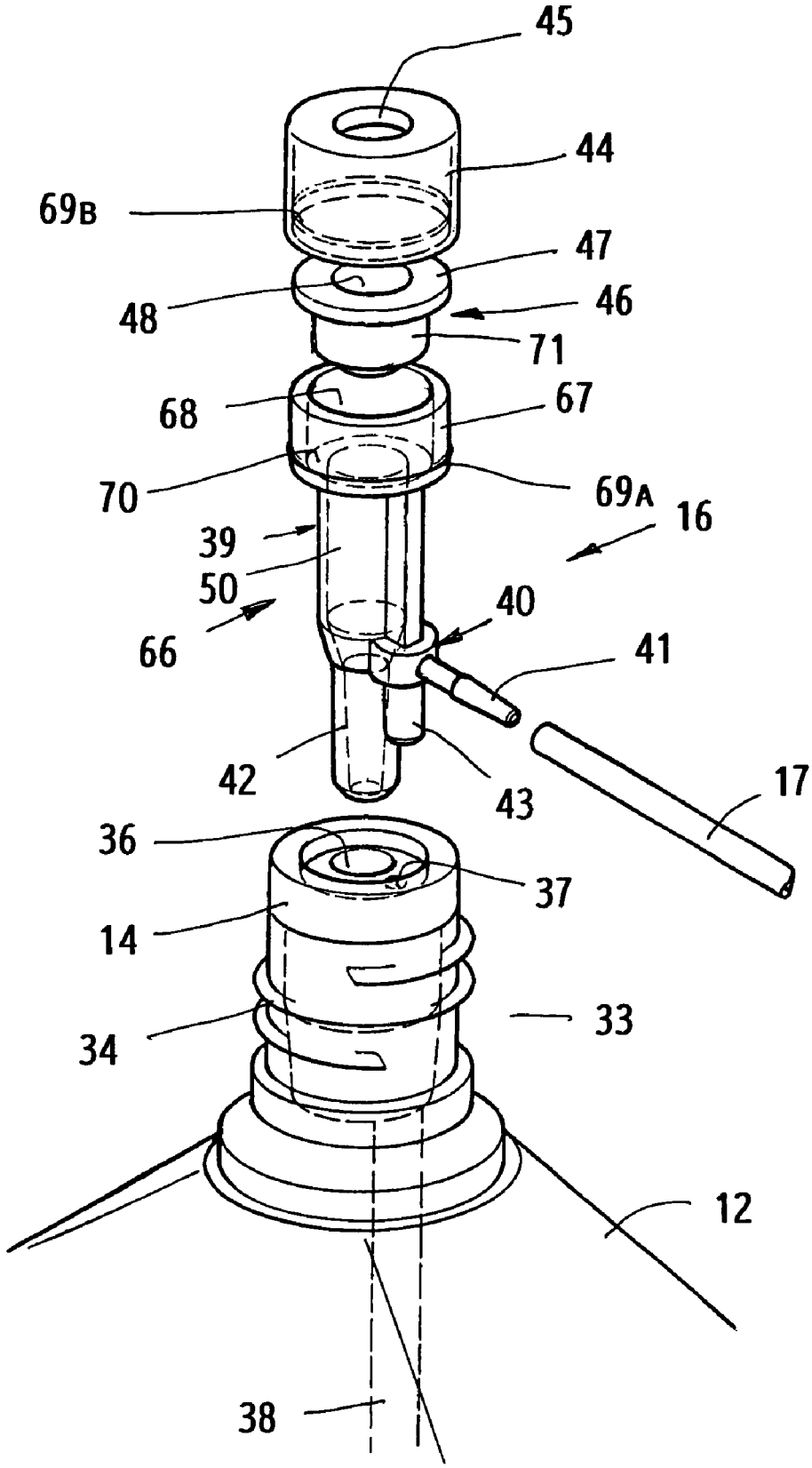
FIG. 6 is a disassembled view of the present invention, showing the assembling relation of the refilling assembly.
Figure 7:
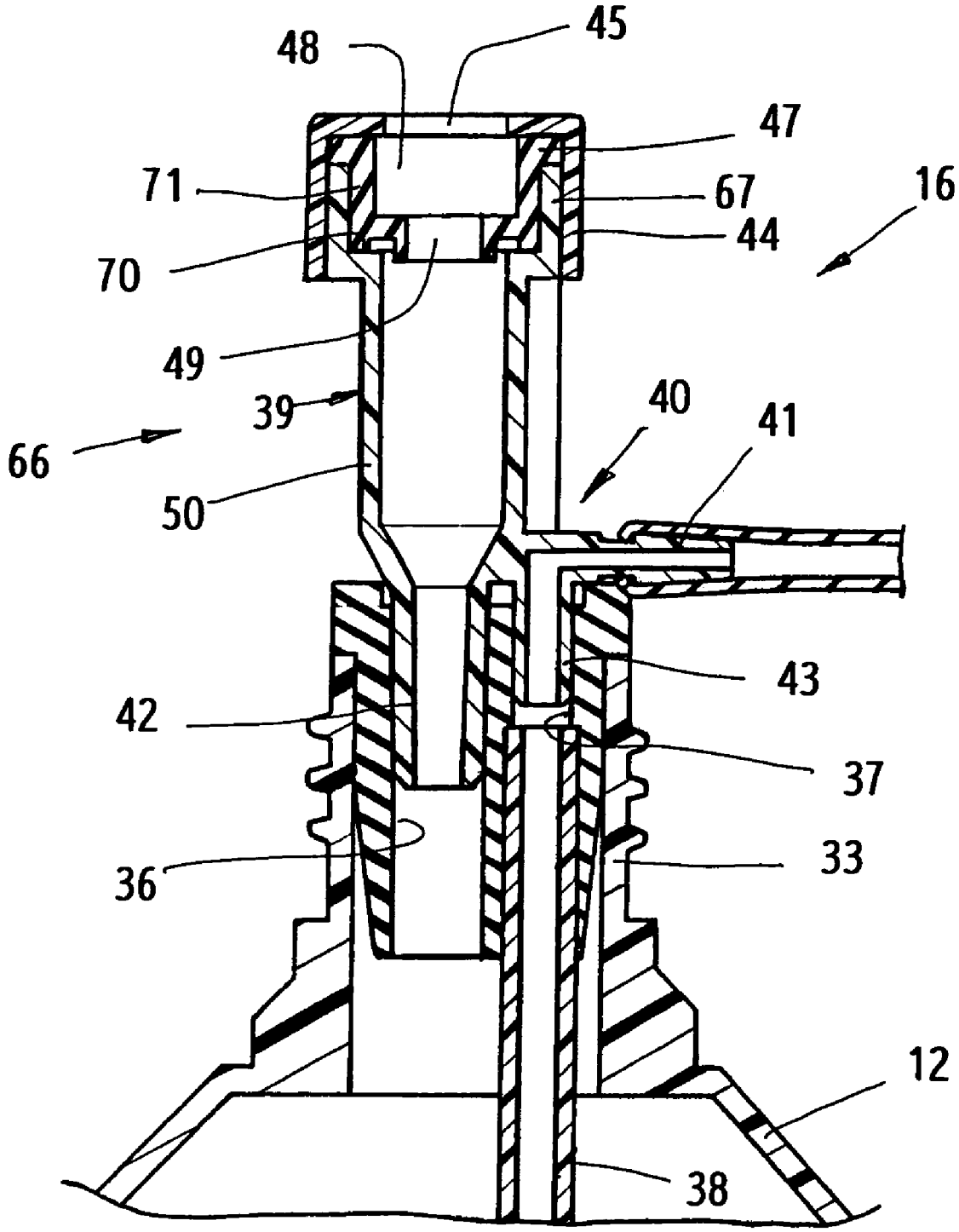
FIG. 7 is a sectional view of the present invention, showing an enlarged view of FIG. 5.

Referring to FIGS. 1 to 3, the ink bottle 12 for refilling the ink cartridge 11 is loaded with ink. The bottle neck 33 of the ink bottle 12 is furnished with threads 34, and with a cylindrical hole for mounting a bottle plug 14. The bottle plut 14 is furnished with two through holes 36 and 37, of which the hole 37 is mounted with a tube 38. After the ink bottle 12 is filled up with ink, a bottle plug 14 is mounted in the bottle neck 33; the top of the bottle plug is mounted with an outer lid 15 so as to present the ink therein from leaking upon the ink bottle being shipped.

Referring to FIGS. 1, 4 to 7, one end of the refilling assembly 13 is first plugged into the bottle plug 14 before the ink cartridge 11 being refilled. The ink bottle connector 16 is furnished with a L-shaped connector 40, of which the outside has a plug pipe 14 to be plugged with a tube 17; the plug pipe 43 on other end of the tube 17 is plugged into a cylindrical hole 37 of the bottle plug 14; the lower part of the cylindrical hole 37 is plugged with a tube 38, of which the tail end can touch the bottom of the ink bottle 12; upon the ink cartridge 11 being filled, the ink will flow into the refilling hole 28 through the tube 38, the cylindrical hole 37 of the bottle plug 14, the L-shaped connector 40 of the ink bottle connector 16, the tube 17, and the ink cartridge connector 18.

The ink bottle connector 16 includes a recovering cylinder 66 and a L-shaped connector 40, which are cast into one piece, and the lower parts thereof are furnished with plug pipes 42 and 43 respectively so as to facilitate them to be plugged into two cylindrical holes 36 and 37 respective by upon the ink bottle connector 16 being plugged into the bottle plug 14 of the ink bottle 12; the plug pipe 43 of the L-shaped connector 40 is used as a guide part during refillin ink, while the recovering cylinder 66 is used for recovering the ink in the syringe 57.

The L-shaped connector 40 and the recovering cylinder 66 are cast onto one piece, which includes a body portion 39, a seal ring 46 and an outer lid 44; the part of the body portion 39 of the recovering cylinder 66 is furnished with a plug pipe 42; the plug pipe 42 and the plug pipe 43 of the L-shaped connector 40 are set in parallel; the body portion 39 of the recovering cylinder 66 is used for gripping with hand. After the ink bottle connector 16 is plugged into the bottle plug 14 of the ink bottle 12, the two plug pipes 42 and 43 in parallel will be plugged into the two cylindrical holes 36 and 37 in the bottle plug 14 simultaneously and hermetically.

The body portion 39 of the recovering cylinder 66 includes a ring-shaped body 67, a cylinder body 50, and a plug pipe 42; the center thereof has a through hole; the cylinder body 50 of the body portion 39 has a given length to facilitate gripping by hand; the ring-shaped body 67 of the body portion has a larger bottom than the diameter of the cylinder body 50, and the ring-shaped body 67 has a suitable height and a retaining ring 69*a*; the center of the ring-shaped body 67 has a cylindrical hole 68; the bottom of the cylindrical hole 68 and the upper part of the cylinder body 50 are formed into a round bottom surface 70. The upper surface of the ring-shaped body 67, the surface of the cylindrical hole 68 and the surface of the bottom surface 70 are used for receiving and connecting the seal ring 46 in close contact.

Figure 14:
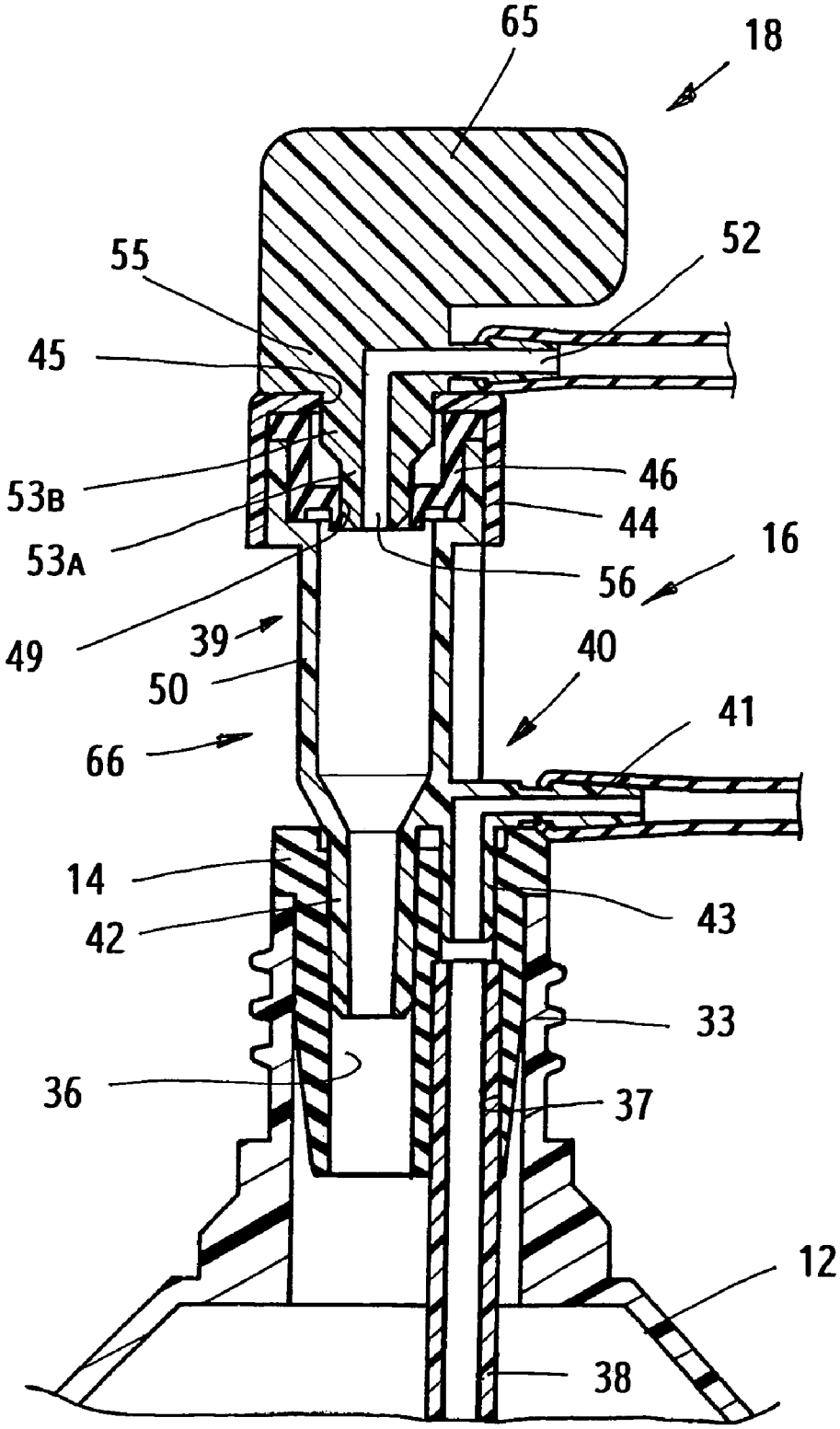
FIG. 14 is a sectional view of the present invention, showing the ink cartridge connector plugged into the top of the ink bottle connector.

The seal ring 46 of the recovering cylinder 66 is made of silicon or the similar material, and it includes a ring-shaped flange 47 and a cylinder body 50; the outer diameter of the ring-shaped flange 47 is slightly smaller than that of the ring-shaped body 67 of the recovering cylinder 66. The outer diameter and height of the plug pipe 71 is so designed as to fit to that of cylindrical hole 68 in the ring-shaped body 67 of the recovering cylinder 66. The center of the seal ring 46 has a recess hole 48, of which the bottom has a through hole 49 with a smaller diameter so as to fit to a plug pipe 53*a* of the ink cartridge connector 18; after the ink cartridge 11 is filled up, the ink cartridge connector 18 will be plugged to the ink bottle connector 16, and the plug pipe 53*a* of the ink cartridge connector 18 and the ink bottle connector 16 can be in close and hermetic connection (as shown in FIG. 14)

The outer lid 44 of the recovering cylinder 66 is ao designed as to fit to the outer diameter of the ring-shaped body 67 on the upper p-art of the recovering cylinder 66, and it is a round lid with a reatining ring 69*b*; after the retaining ring 69*b* holds the outer lid 44 to be mounted over the ring-shaped body 67, the outer lid 44, the seal ring 46 and the ring-shaped body 67 will be assembled together as one piece. The outer lid 44 has a cylindrical hole 45, of which the diameter is designed to fit to a plug pipe 53*b* having a larger diameter; after the ink cartridge 11 is filled up, the ink cartridge connector 18 of the refilling assembly 13 can directly be plugged to the upper part of the ink bottle connector 16 (as shown in FIG. 14)

One side of the lower part of the recovering cylinder 66 in the ink bottle connector 16 of the refilling assembly 13 is furnished with a L-shaped connector 40, of which one side has a plug pipe 41 for receiving one end of the tube 17; the other end of the tube 17 is connected with the plug pipe 51 of the ink cartridge 18. The plug pipe 53 on the other end of the plug pipe 51 is designed to fit to the diameter of the refilling hole 28 of the ink cartridge 11. The grip plate 65 can be gripped with hand so as to plug into the refilling hole 28 of the ink cartridge 11, and to guide the ink during the ink cartridge 11 being refilled.

As shown in FIGS. 1, 8, 9 and 14, the ink cartridge connector 18 mounted in the refilling hole 28 of the ink cartridge 11 includes a L-shaped connector 54, a stop plate 55, a grip plate 65 and a plug pipe 53; the stop plate 55 is substantially a thin and round plate with a grip plate 65 and a plug pipe 53 in the lower part thereof; the L-shaped connector 54 is furnished between one side of the stop plate 55 and the plug pipe 53; one side of the stop plate 55 is furnished with a plug pipe 51, of which the center has a cylindrical hole 52. The center of the plug pipe 51 has a cylindrical hole 56; the two cylindrical holes 52 and 56 are designed in L-shaped connector 54, and the grip plate 65 over the plug pipe 53 can provide the plug pipe 53 with a portection function.

The plug pipe 51 extended out of the stop plate 55 of ink cartridge connector 18 is to be connected with a tube 17. The grip plate 65 on the stop plate 55 is furnished above the plug pipe 51. The grip plate 65 extends at a given length in the same direction of the tube 17; when the ink cartridge connector 18 is gripped with hand, it can provide a user with a right direction to facilitate a hand to grip and to apply a given pressure to have the ink cartridge connector 18 plugged into the refilling hole 28 of the ink cartridge 11.

The plug pipe 53 under the stop plate 55 of the ink cartridge connector 18 is furnished with at least one cylinder body with a diameter to fit to the diameter of the refilling hole 28 of the ink cartridge 11; the ink refilling operation can be done by gripping the grip plate 65 of the ink cartridge connector 18 to plug the plug pipe 53 into the refilling hole 28 of the ink cartridge 11.

Figure 8:
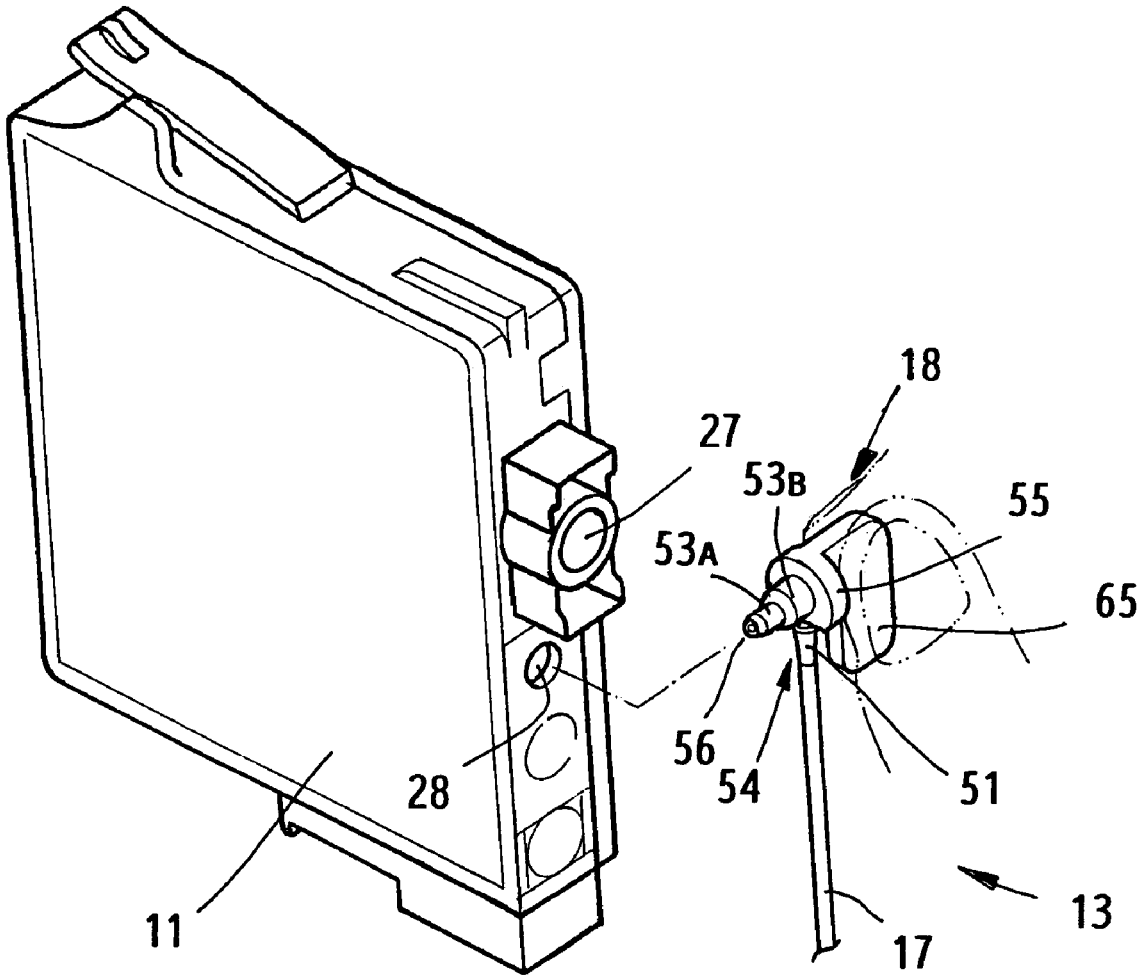
FIG. 8 is a disassembled view of the present invention, showing the ink cartridge connector being plugged with the ink connector.
Figure 9:
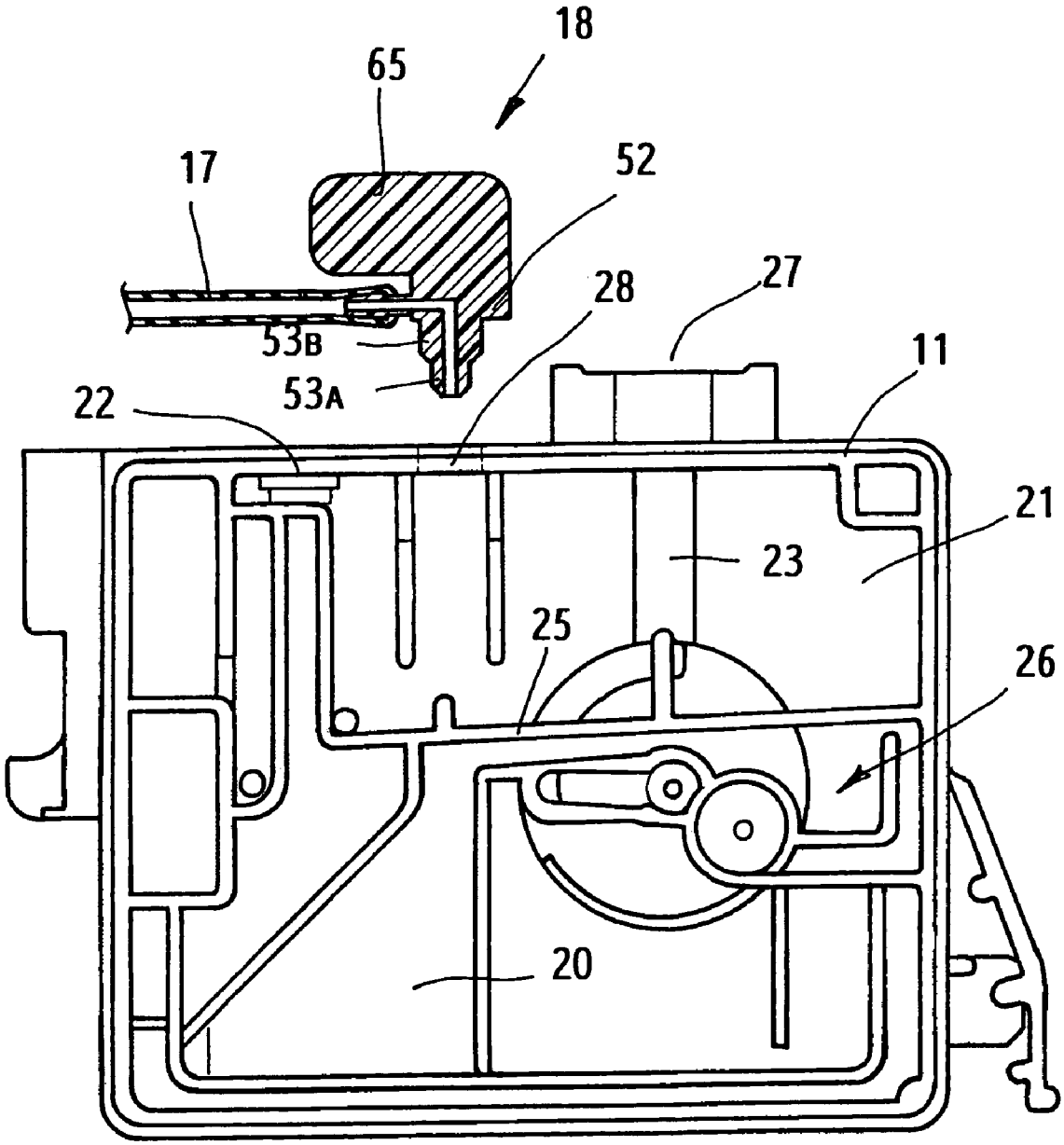
FIG. 9 is a sectional view of the present invention, showing the connection relation between the ink cartridge connector and the ink cartridge.

As shown in FIGS. 8 and 9, the plug pipe 53 of the ink cartridge connector 18 is furnished with two plug pipes 53*a* and 53*b* having different diameters respectively so as to fit to the refilling hole 28 of the DURABrite cartridge in the present market, but the ink cartridge connector 18 is a single one. The plug pipe 53 may have only one diameter, which can only be used for one ink cartridge for refilling upon plugging into the refilling hole 28 of an ink cartridge 11.

Referring to FIGS. 1, 4, 5, 8 to 10, the ink cartridge 11 and the ink bottle 12 are placed in containing boxes 31 and 32 respectively before refilling operation; a membrance attached to the refilling hole 28 is first removed, and the outer lid 15 of the ink bottle 12 is removed; the ink bottle connector 16 of the refilling assembly 13 is moved to the two cylindrical holes 36 and 37 of the ink bottle 12 so as to have the L-shaped connector 40 of the ink bottle connector 16 extended, through the bottle plug 14 and the tube 38, into the ink. The refilling assembly 13 has a tube 17 with a suitable length; one end of the tube 17 is an ink cartridge connector 18; the user may grip the grip plate 65 so as to have the plug pipe 53 plugged into the refilling hole 28 of the ink cartridge 11 to complete the connection of the refilling assembly 13.

As shown in FIGS. 1, 9 and 10, the ink cartridge 11 has two ink chambers 20 and 21, which are communicated each other through a capillary tube 22. One side of the first ink chamber 20 has a loop circuit 26 in communication with an ink storage chamber 23; upon the ink cartridge 11 being refilled, a syringe 57 with a capacity two times of that of the ink cartridge 11 is plugged, by means of a plug pipe 60, into an ink outlet 27 of the ink cartridge 11. As soon as the pull grip 58 of the syringe 57 is pulled, a vacuum suction force will be generated to have the ink chambers 20 and 21 had a negative pressure; in that case, the refilling assembly 13 mounted between the ink cartridge 11 and the ink bottle 12 can guide the ink to flow into the ink cartridge 11.

The ink can flow into the second ink chamber 21 above the partition plate 25 through the ink cartridge connector 18 in the refilling hole 28 of the ink cartridge 11; as soon as the ink level reaches a critical point of the capillary tube 22, the ink will flow, through the capillary tube 22, into the first ink chamber 20. After the ink flows into the first ink chamber, the ink level will be raised gradually until reaching the loop circuit space; then, the ink will flow along the loop circuit space into different space blocks, and into the exhausting level; in that case, the air in the loop circuit space will be exhausted upon the syringe 57 sucking.

Upon the syringe 57 sucking the ink in the ink bottle 12 to flow into the ink cartridge 11, the syringe 57 can only draw air out of the ink chambers 20 and 21; the ink and air bubbles are mixed together gradually; then, the ink is mixed with small bubbles; finally, the ink is mixed with no bubbles; then, the loop circuit 26 and the ink storage chamber 23 under the ink outlet 27 of the ink cartridge 11 are filled up with ink without any bubbles. After the ink cartridge 11 is plugged in a printer to print, there will be no any bubble between the ink storage chamber 23 of the ink cartridge 11 and the ink nozzle, i.e., there will be no any bubble blockage taking place to impact printing operation.

As soon as the cartridge 11 is filled up, remove the syringe 57 from the ink outlet 27 of the ink cartridge 11; then, the air in the ink left in the syringe 57 must be removed first before the syringe being plugged in the revovering cylinder 66 of the ink bottle connector 16; the ink in the syringe 57 is poured into the ink bottle 12.

Figure 11:
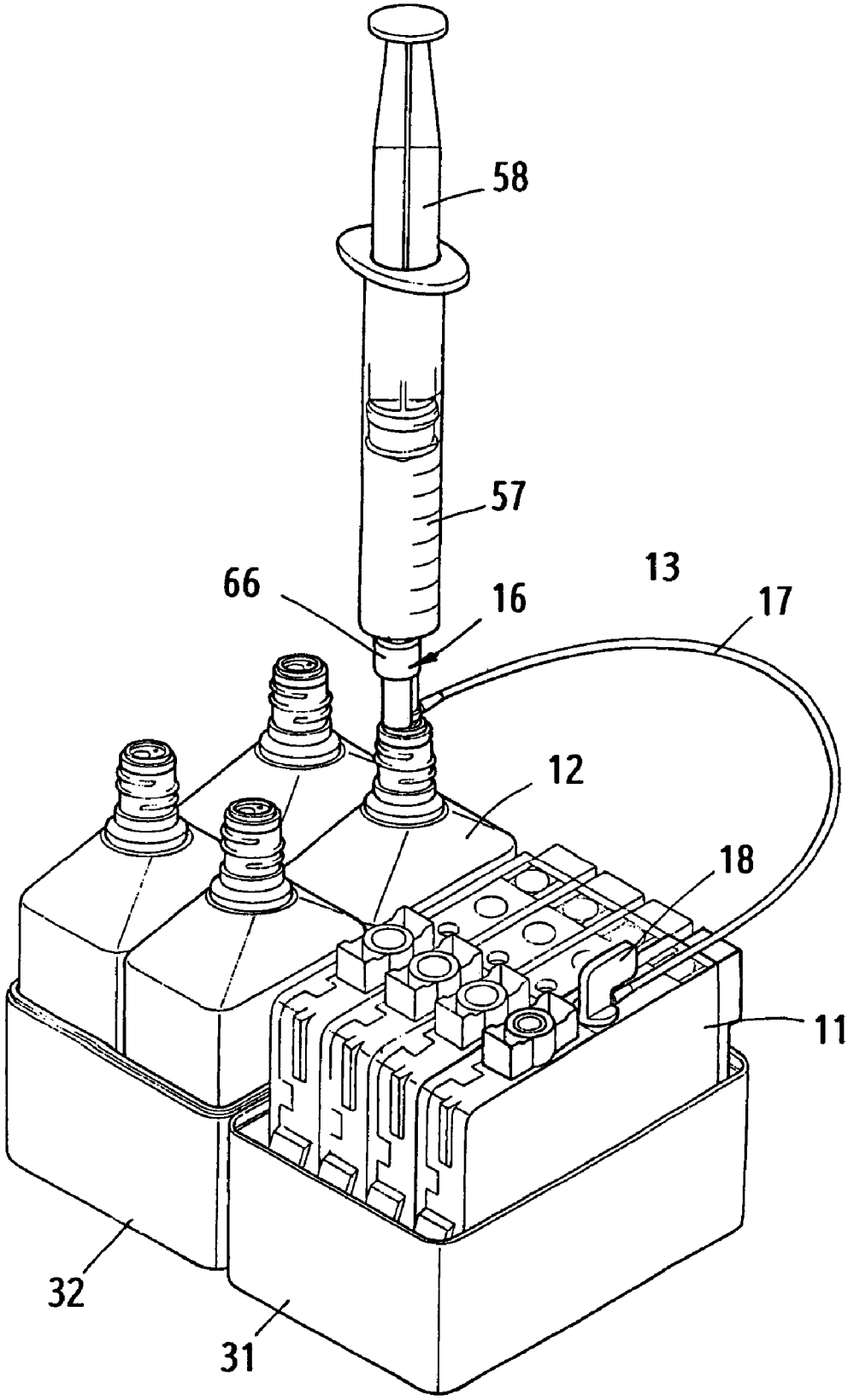
FIG. 11 is a perspective view of the present invention, showing the syringe being assembled for recovering operation.
Figure 12:
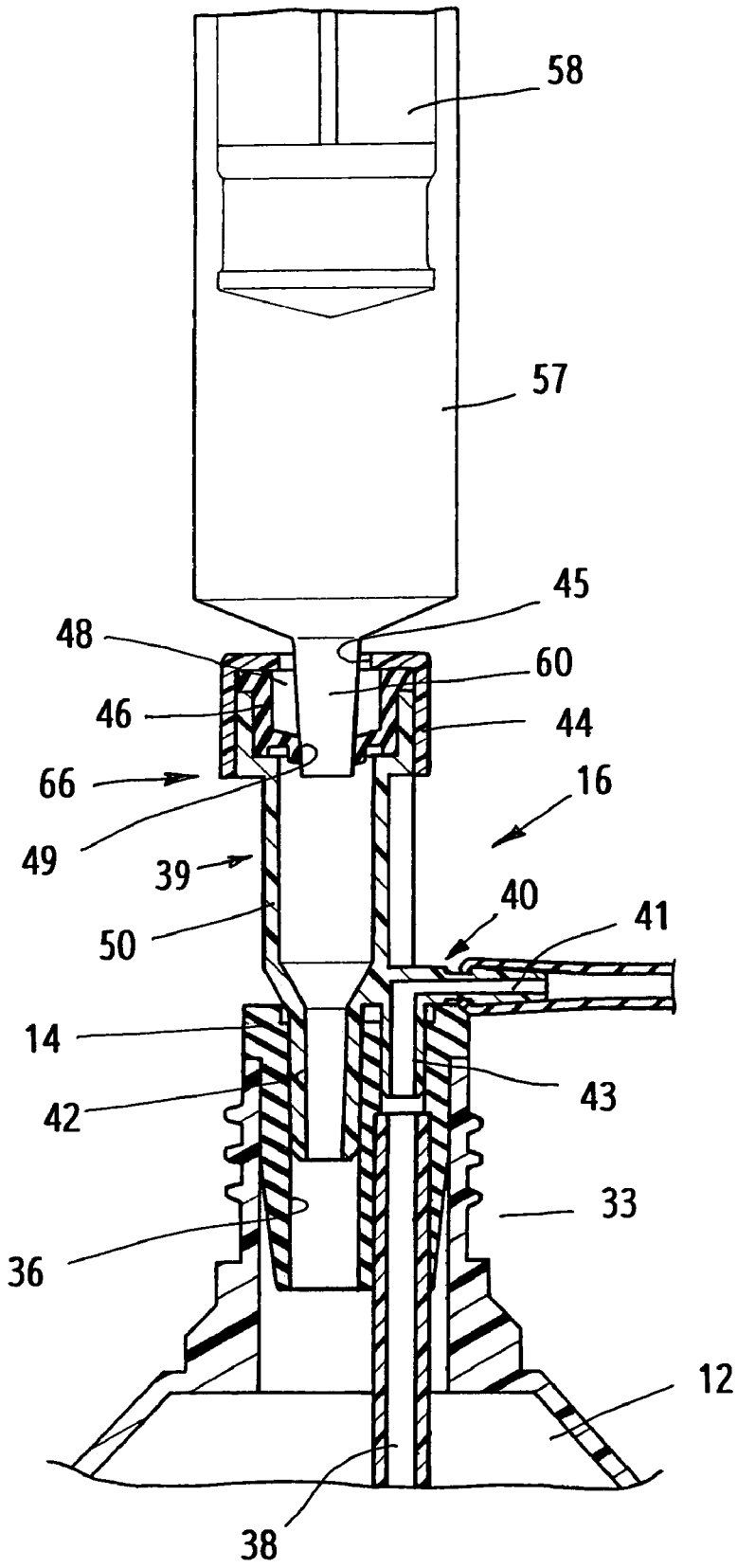
FIG. 12 is a sectional view of the present invention, showing the plug pipe of the syringe plugged into the ink bottle connector closely.
Figure 13:
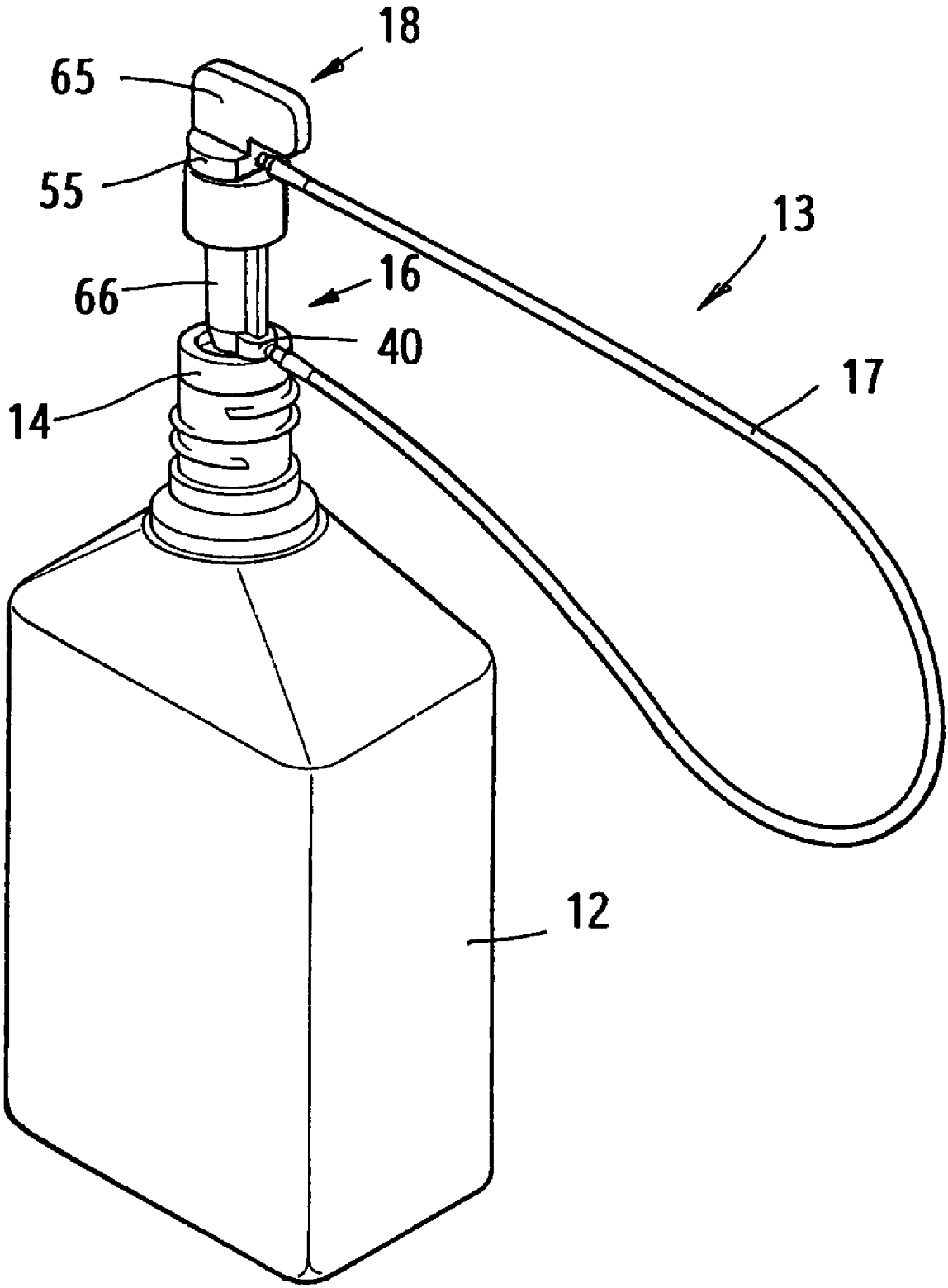
FIG. 13 is a perspective view of the present invention, showing the ink cartridge connector plugged into the top of the ink bottle connector.

As shown in FIGS. 11 to 13, the air in the syringe 57 has been exhausted first, and only ink left therein; then, let the plug pipe 60 of the syringe 57 plug into the cylindrical hole 45 of the recovering cylinder 66 of the ink bottle connector 16; the plug pipe 60 has a fixed length; the seal ring 46 of the recovering cylinder 66 is made of silicon, and it has a suitable flexibility; after the plug pipe 60 of the syringe 51 is plugged into the recovering cylinder 66, the plug pipe 60 and the through hole 49 of the seal ring 46 will have a pressure and hermetical connection each other because of the diameter of the plug pipe 60 being slightly larger than that of the through hole 49; therefore, when the syringe 57 is operated to recover ink, there will be no leakage taking place.

When the ink cartridge connector 18 at one end of the tube 17 of the refilling assembly 13 is plugged in the ink cartridge 11, and the ink bottle connector 16 is connected with the ink bottle 12, the syringe 57 can be pulled up so as to draw air out of the ink bottle 12; as soon as the pull grip 58 is released, the inside of the ink bottle 12 will generate a vacuum suction force to have the ink in the syringe 57 flowed into the ink bottle 12 so as to recover the ink left in the syringe 57 easily. As a result of the inside of the ink bottle 12 having a negative pressure, the ink in the tube 17 will be sucked into the ink bottle 12 upon the ink cartridge connector 18 being removed from the refilling hole 28 of the ink cartridge 11, i.e., to have the ink left in the tube 17 flowed back into the ink bottle 12 completely.

After the ink cartridge connector 18 is removed from the ink cartridge 11, the refilling hole 28 should be sealed with a plastic plug; then, the ink cartridge 11 filled up with ink can be mounted to a printer for printing operation.

As soon as the syringe 57 is removed from the ink bottle connector 16, a lid should be mounted to seal the connector; the ink cartridge connector 18 removed from the refilling hole 28 in the ink cartridge 11 is then plugged on the top of the recovering cylinder 66 of the ink bottle connector 16.

As shown in FIGS. 13 and 14, the ink cartridge connector 18 is plugged into the recovering cylinder 66 hermetically by means of the diameter of the through hole 49 under the recess hole 48 of the seal ring 46 and the diameter of the plug pipe 53*a* of the ink cartridge connector 18 being matched closely, i.e., the plug pipe 53*a* of the ink cartridge connector 18 and the through hole 49 under the seal ring 46 being connected together hermetically as one piece. The plug pipe 53*b* of the ink cartridge connector 18 and the cylindrical hole 45 of the outer lid 44 are also connected together closely so as to have the ink cartridge connector 18 plugged on the ink bottle connector 16, and to have ink cartridge connector 18 and the ink bottle connector 16 connected closely as one piece. The circuit in the refilling assembly 13 has a convection and cycling effect without affecting the storage of ink inside the ink bottle 12.

The aforesaid refilling assembly 13 of the ink cartridge 11 is connected with the ink bottle connector 16 by means of the cylindrical holes 36 and 37 on the ink bottle 12, and an ink cartridge connector 18 plugged into the refilling hole 28 of the ink cartridge 11; then, a syringe 57 is plugged into the ink outlet 27 of the ink cartridge 11; the syringe 57 can be pulled up to perform ink refilling operation so as to have the ink chamber 23 in the ink cartridge had no air bubbles left therein; the ink left in the syringe 57 can be recovered upon the syringe being plugged to the recovering cylinder 66 of the ink bottle connector 16; then, the ink cartridge connector 18 removed form the refilling hole 28 in the ink cartridge 11 is plugged to the ink bottle connector 16; the refilling assembly 13 is plugged on the ink bottle 12 so as to save steps of cleaning the refilling assembly 13, and also to facilitate the next refilling to the ink cartridge 11; in that case, the ink cartridge connector 18 can easily be removed and plugged into the refilling hole 28 of the ink cartridge 11.

If the refilling refilling assembly of the DURABrite cartridge is used for mounting on a connector of an ink bottle 12 which is not relgated to the present invention, the ink bottle connector 16 of the refilling assembly 13 may be removed, and the tube 17 can be plugged into the ink bottle; the ink cartridge connector 18 may directly be plugged into the refilling holl 28 of the ink cartridge 11; in fact, the aforesaid guide method can still fill up an ink cartridge 11 to obtain the same result as desired; however, the ink guided into the syringe 57 must be poured into the ink bottle carefully; in other words, the refilling assembly 13 assembled with a tube 17 and an ink cartridge connector 18 can also provide the same function as that of the DURABrite ink cartridge.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. A simplified refilling assembly of DURABrite ink cartridge comprising:

an ink bottle connector including a L-shaped connector, of which an outer edge and a recovering cylinder are molded into one piece, and one end thereof having a plug pipe to be connected with a pipe, while other end thereof being plugged to an ink bottle; including a recovering cylinder, of which outer edge and a L-shaped connector are molded into one piece; lower part thereof having a plug pipe, while upper part thereof having a ring-shaped body to be mounted with a seal ring, and outer edge thereof being covered with an outer lid;

a pipe having a loop-shaped body, and one end thereof connected with said L-shaped connector of said ink bottle connector, and other end thereof connected with a L-shaped connector of an ink cartridge connector;

said ink cartridge connector having a L-shaped connector on a stop plate thereof; outer end thereof having a plug pipe connected with said pipe; said stop plate having a plug pipe thereunder, and diameter thereof being designed to match with that of a refilling hole of said ink cartridge.

2. A simplified refilling assembly of DURABrite ink cartridge as claimed in claim 1, wherein said L-shaped connector and said recovering cylinder of said ink bottle connector are molded into one piece.

3. A simplified refilling assembly of DURABrite ink cartridge as claimed in claim 1, wherein lower part of said L-shaped connector and said recovering cylinder of said ink bottle are furnished with two parallel plug pipes to be plugged into two cylindrical holes respectively on a bottle plug on said ink bottle.

4. A simplified refilling assembly of DURABrite ink cartridge as claimed in claim 1, wherein upper part of said recovering cylinder of said ink bottle connector has a ring-shaped body with a cylindrical hole to be loaded with a seal ring, and then an outer lid is mounted thereon closely.

5. A simplified refilling assembly of DURABrite ink cartridge as claimed in claim 1, wherein said seal ring on upper part of said recovering cylinder of said ink bottle connector is furnished with a ring-shaped flange having a recess hole in center thereof, and said recess hole having a through hole with a smaller diameter; after said seal ring being mounted in a cylindrical hole of said recovering hole, outer edge thereof and said cylindrical hole being in close and hermetical connection.

6. A simplified refilling assembly of DURABrite ink cartridge as claimed in claim 1, wherein said seal ring furnished on upper part of said recovering cylinder of said ink bottle has a recess hole with a through hole, of which the diameter is designed to match that of a plug pipe of said ink cartridge connector so as to have said two assemblies connected together closely and hermetically.

7. A simplified refilling assembly of DURABrite ink cartridge as claimed in claim 1, wherein said outer lid on said cylindrical recovering cylinder of said ink bottle connector has a cylindrical hole in center thereof, and said outer lid mounted on a ring-shaped body; diameter of said cylindrical hole is designed to match that of a plug pipe so as to have said two parts connected together closely and hermetically.

8. A simplified refilling assembly of DURABrite ink cartridge as claimed in claim 1, wherein said ink cartridge connector includes:

a stop plate which is a round and thin plate with a grip plate on upper thereof, and a plug pipe on lower part thereof;

a L-shaped connector furnished between said stop plate and said plug pipe, and having a plug pipe extended out one side of said stop plate, and said plug pipe having a cylindrical hole; center of said stop plate having a plug pipe with a cylindrical hole which is in a L-shaped communication with a cylindrical hole fo an outer plug pipe;

a grip plate furnished on top of said stop plate, and having a given thickness and width, and extended in a direction along said plug pipe of said L-shaped connector; and a plug pipe furnished under center of said stop plate, and having a diameter to match with that of a refilling hole of said ink cartridge.

9. A simplified refilling assembly of DURABrite ink cartridge as claimed in claim 1, wherein lower part of said stop plate of said ink cartridge connector has a plug pipe which is designed to match with a diameter of said refilling hole of said ink cartridge.

10. A simplified refilling assembly of DURABrite ink cartridge as claimed in claim 1, wherein said plug pipe under said stop plate of said ink cartridge connector has a single diameter, and is designed to match with diameter of said refilling hole of one single ink cartridge so as to have an ink cartridge connector plugged in a refilling hole of said ink cartridge.

11. A simplified refilling assembly of DURABrite ink cartridge comprising:

an ink bottle connector plugged in an ink bottle for refilling into an ink cartridge;

a tube being a loop-shaped tube, and one end thereof plugged into an ink cartridge connector, while other end thereof plugged into a L-shaped connector of said ink cartridge connector;

said ink cartridge connector having a L-shaped connector on a stop plate thereof, and outer end thereof having a plug pipe to be connected with a pipe; a plug pipe furnished under said stop plate, and diameter of said plug pipe is designed to match with that of said ink bottle connector.

12. A simplified refilling assembly of DURABrite ink cartridge as claimed in claim 11, wherein said ink cartridge connector includes:

a stop plate which is a thin and round plate, and upper part thereof having a grip plate, while lower part thereof having a plug pipe;

a L-shaped connector having a stop plate, and a plug pipe furnished between said stop plate and a lower plug pipe, i.e., extended out from one side of said stop plate, and said plug pipe having a center through hole to be in communication in L-shaped with a cylindrical hole of a side plug pipe;

a grip plate furnished above said stop plate, and having a given thickness and width, and one end thereof extended in a direction of a plug pipe of a L-shaped connector;

a plug pipe furnished under center of said stop plate, and having a given diameter; and said diameter designed to match with that of a refilling hole of said ink cartridge.

13. A simplified refilling assembly of DURABrite ink cartridge as claimed in claim 11, wherein one end of a pipe of said refilling assembly is plugged into said ink cartridge connector, while other end thereof plugged directly into said ink bottle.

* * * * *